US006375631B2

(12) United States Patent
Harris et al.

(10) Patent No.: US 6,375,631 B2
(45) Date of Patent: Apr. 23, 2002

(54) APPARATUS FOR PERFORMING SPINAL THERAPY

(75) Inventors: Robert D. Harris, Logan, UT (US); William R. Hachtmann, Oakhurst, CA (US); Daniel Haynie, North Logan, UT (US)

(73) Assignee: RDH Enterprises, LLC, Logan, UT (US)

( * ) Notice: Subject to any disclaimer, the term of this patent is extended or adjusted under 35 U.S.C. 154(b) by 0 days.

(21) Appl. No.: 09/778,611

(22) Filed: Feb. 7, 2001

Related U.S. Application Data

(60) Provisional application No. 60/180,803, filed on Feb. 7, 2000.

(51) Int. Cl.[7] ..... A61H 1/00

(52) U.S. Cl. ..... 601/98; 601/84; 601/101; 601/24; 606/240

(58) Field of Search ..... 601/107, 108, 601/84, 97, 98, 100, 1, 23, 24, 26, 115; 602/32–35, 38; 606/240–242, 201; 482/131–134, 141–143

(56) References Cited

U.S. PATENT DOCUMENTS

| | | | | | |
|---|---|---|---|---|---|
| 439,255 | A | * | 10/1890 | Ruebsam | |
| 3,800,785 | A | * | 4/1974 | Inada | 128/52 |
| 3,998,218 | A | | 12/1976 | Lane et al. | |
| 4,583,255 | A | | 4/1986 | Mogaki et al. | |
| 4,664,099 | A | * | 5/1987 | Pearl, Jr. | 128/75 |
| 5,060,636 | A | | 10/1991 | Bell | |
| 5,133,741 | A | | 7/1992 | Filho | |
| 5,232,427 | A | * | 8/1993 | Paro | 482/131 |
| 5,277,676 | A | * | 1/1994 | Holland et al. | 482/39 |
| 5,279,310 | A | | 1/1994 | Hsien | |
| 5,711,749 | A | * | 1/1998 | Miller | 482/135 |
| 5,713,841 | A | | 2/1998 | Graham | |
| 6,174,296 | B1 | * | 1/2001 | Wang | 601/114 |

* cited by examiner

*Primary Examiner*—Justine R. Yu
(74) *Attorney, Agent, or Firm*—Kelly Bauersfeld Lowry & Kelley, LLP

(57) ABSTRACT

An apparatus for performing spinal therapy is disclosed and includes a base assembly having a pair of spaced-apart, vertically extending guide posts and at least one stabilizing foot associated with each guide post and capable of pivoting from a folded to an expanded position to stabilize the apparatus during use. A lift bar assembly is disposed between the guide posts. The lift bar assembly includes a horizontal cross bar interconnected between two lift bars which are slidably attached to the guide posts. An elongated fluid filled pad is disposed between the guide posts and over at least a portion of the horizontal cross bar. An actuator, including a motor operably connected to the lift assembly, is used to selectively raise and lower the lift bar assembly. A cable and pulley system is incorporated into the apparatus for raising and lowering the lift bar assembly in a uniform manner.

30 Claims, 2 Drawing Sheets

APPARATUS FOR PERFORMING SPINAL THERAPY

RELATED APPLICATION

This application claims priority from provisional application Ser. No. 60/180,803 filed Feb. 7, 2000.

BACKGROUND OF THE INVENTION

The present invention relates to exercise and physical therapy machines. More particularly, the present invention relates to a process for performing spinal therapy using an apparatus which provides vertical lifting action of a user's spine.

The spine is comprised of a bony column forming the main structural support of the human skeleton. It consists of vertebrae segments linked by flexible joints and held together by gelatinous discs of cartilage and ligaments. Each vertebrae has a somewhat cylindrical bony body, a number of wing-like projections, and a bony arch. There are twenty-four movable vertebrae, seven cervical, twelve dorsal and five lumbar.

The lumbar and cervical regions of the spine normally define forward curves of about 35 to 45 degrees, whereby weight is distributed relatively evenly on the individual discs within the region. This curvature can be lost due to a variety of causes, including injury from lifting, bad posture, sitting for prolonged periods of time, viewing computer monitors in a "haunched" position, and increased age. When the curvature is lost, uneven and increased pressure develops on a few of the vertebrae and inflammation or restricted fluid flows occurs resulting in back pain and loss of mobility.

It is estimated that between 60% and 80% of the general population will suffer from low back pain at one point in their lives, and that between 20% and 30% of the population are suffering from back pain at any given time. An underlying problem with nearly all back pain is the compression of the spinal vertebrae and/or surrounding muscle tension. If left untreated, the uneven weight on the vertebrae can cause intervertebral discs to wear and degenerate, neuralgic problems such as pinched nerves can arise, and calcification and scarring of the spine can occur. Over time, the loss of mobility can cause the spine to lose its curvature and a rounded hump, known as Dowagers Hump, can develop with increased age.

It is generally accepted that proper mobilization and stretching of the spine can alleviate pain and increase range of motion as well as the overall function of the back and body. A number of devices exist which attempt to remedy back pain by stretching and strengthening the back and spine. However, all of these devices suffer certain drawbacks. Some of the devices are active in that the user must move his or her body, sometimes with resistance, in order to attain the stretch or exercise the back muscles. For many who suffer back pain, these motions and accompanying resistance are too rigorous to be performed without pain. If not done correctly, these exercises can also actually create back injury and pain.

Other devices are passive in that the user positions himself or herself on the device and either the inherent shape of the device provides the stretch, or moving parts of the device stretch the back and spine. Although preferable over the active devices, these devices also suffer drawbacks. Many of the devices move parts into the spine causing discomfort. Others are cushioned so as to conform to the body of the user, however, due to the wide variety of body types and sizes, the nonconforming cushioning can create undesirable and uncomfortable pressure points in many users' backs. Other moving devices are large, complicated, cumbersome and expensive. Non-moving devices, such as pillows and mattresses, which are contoured also suffer the drawbacks of not being able to conform to all body styles and shapes. There are yet other devices, such as fluid-filled spheres which do not create uncomfortable pressure points and conform to the user. Unfortunately, the pressure gradient intended to be applied to properly stretch and posture the spine is lost. Nearly all of the above devices fail to grant the user control over the degree of pressure or posturing applied.

Accordingly, there is a need for an apparatus which passively treats the spine and applies a sufficient pressure gradient to the area to be treated without causing pressure point discomfort in the user's back. What is also needed is an apparatus which utilizes both a mechanically created pressure gradient as well as a universally useable cushion which are controlled by the user to treat the user's back. What is further needed is an apparatus which is uncomplicated, relatively inexpensive and easily stored. The present invention fulfills these needs and provides other related advantages.

SUMMARY OF THE INVENTION

The present invention resides in a spinal therapy apparatus which passively treats the spine and applies sufficient pressure gradient to the area to be treated without causing pressure point discomfort in the user's back. The apparatus is generally comprised of a base assembly having a pair of vertically extending guide post spaced from one another, a lift bar assembly slidably attached to the guide posts, and an actuator which selectively raises and lowers the lift bar assembly relative to the base assembly.

The base assembly includes a stabilizing foot associated with each guide post that is capable of pivoting from a folded to an expanded position. Preferably, a plurality of stabilizing feet pivot away from one another to an expanded and locked position to stabilize the apparatus during use.

The lift bar assembly comprises a horizontal cross bar interconnected between to lift bars. The lift bars are configured to interiorly receive the guide posts. An elongated fluid filled pad is disposed between the guide posts and over at least a portion of the horizontal cross bar.

The actuator comprises a motor which is operably connected to the lift assembly. Typically, the apparatus includes a cable and pulley system for raising the lowering the lift bar assembly in a uniform manner. The cable and pulley system comprises a cable interconnected between a top portion of each guide post, and extending through the lift bar assembly to pulleys associated with each lift bar so that as one lift bar is raised or lowered, the other lift bar raises or lowers in a similar manner.

In use, a user of the device lies on the pad and actuates the motor to raise the lift bar assembly until a sufficient pressure gradient is applied to the area of the back to be treated. If the pressure gradient is exceeded, the user may actuate the motor to lower the lift bar assembly. Similarly, if additional pressure is desired, the user actuates the motor to raise the lift bar assembly. The user can position the area to be treated directly over the horizontal cross bar, or an area of the back adjacent to the area to be treated depending upon the level of discomfort and the aggressiveness of the therapy.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
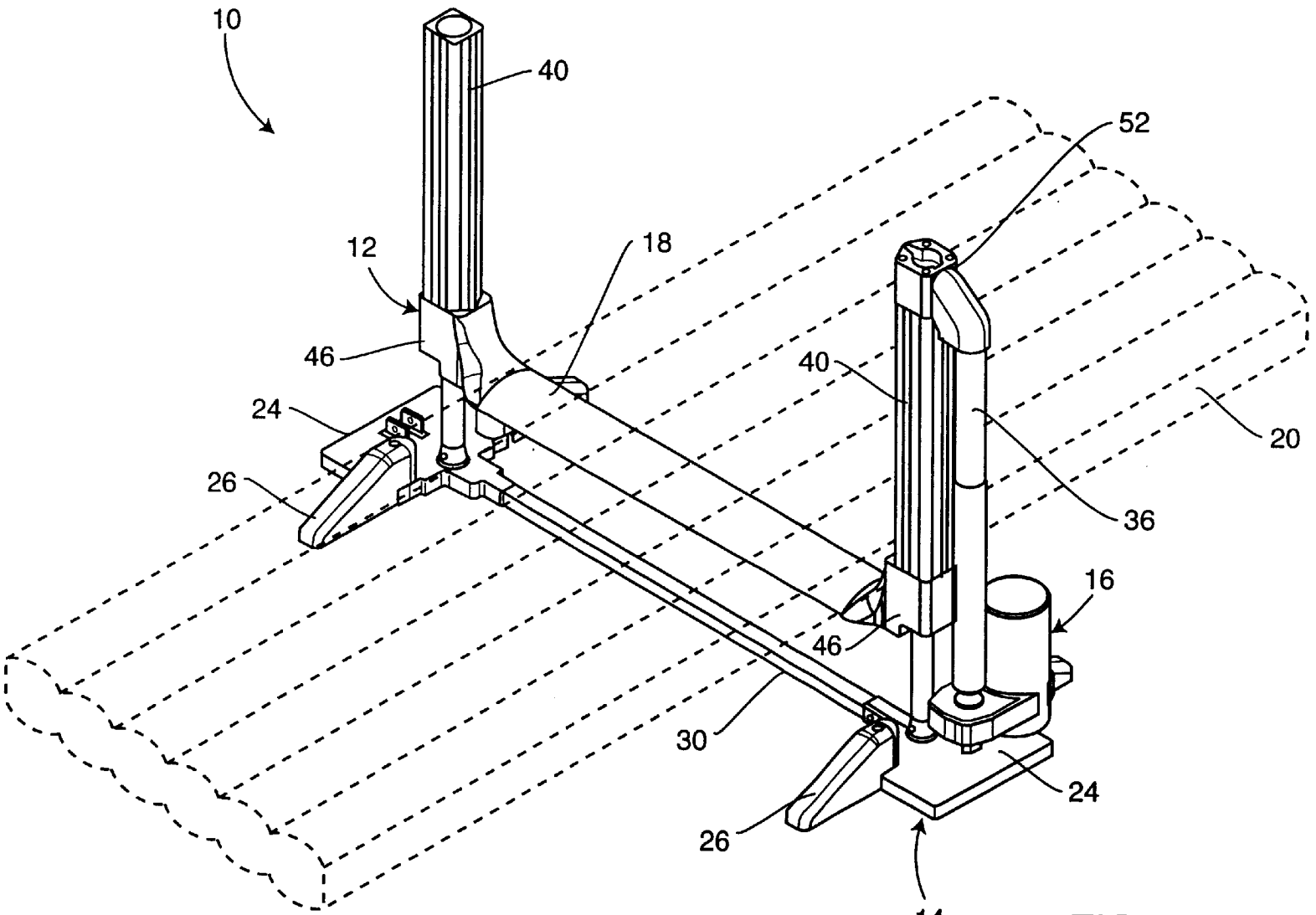
FIG. 1 is a perspective view of a spine therapy apparatus embodying the present invention and having a fluid-filled mattress positioned thereon in phantom.

As shown in the drawings for purposes of illustration, the present invention is concerned with a spinal therapy apparatus, generally referred to by the reference number 10. With reference to FIG. 1, the apparatus 10 generally is comprised of a lift bar assembly 12 which is movably positioned on a stationary base assembly 14 in response to a linear actuator 16 which is connected to the lift bar assembly 12. The apparatus 10 is designed to provide vertical lifting action across a portion of a user's spine by a low profile horizontal cross bar 18 which passively exercises and stretches the spine and back. A fluid filled pad 20, such as an inflated air mattress, is preferably positioned over the horizontal bar 18 to provide cushion support for the user.

Figure 2:
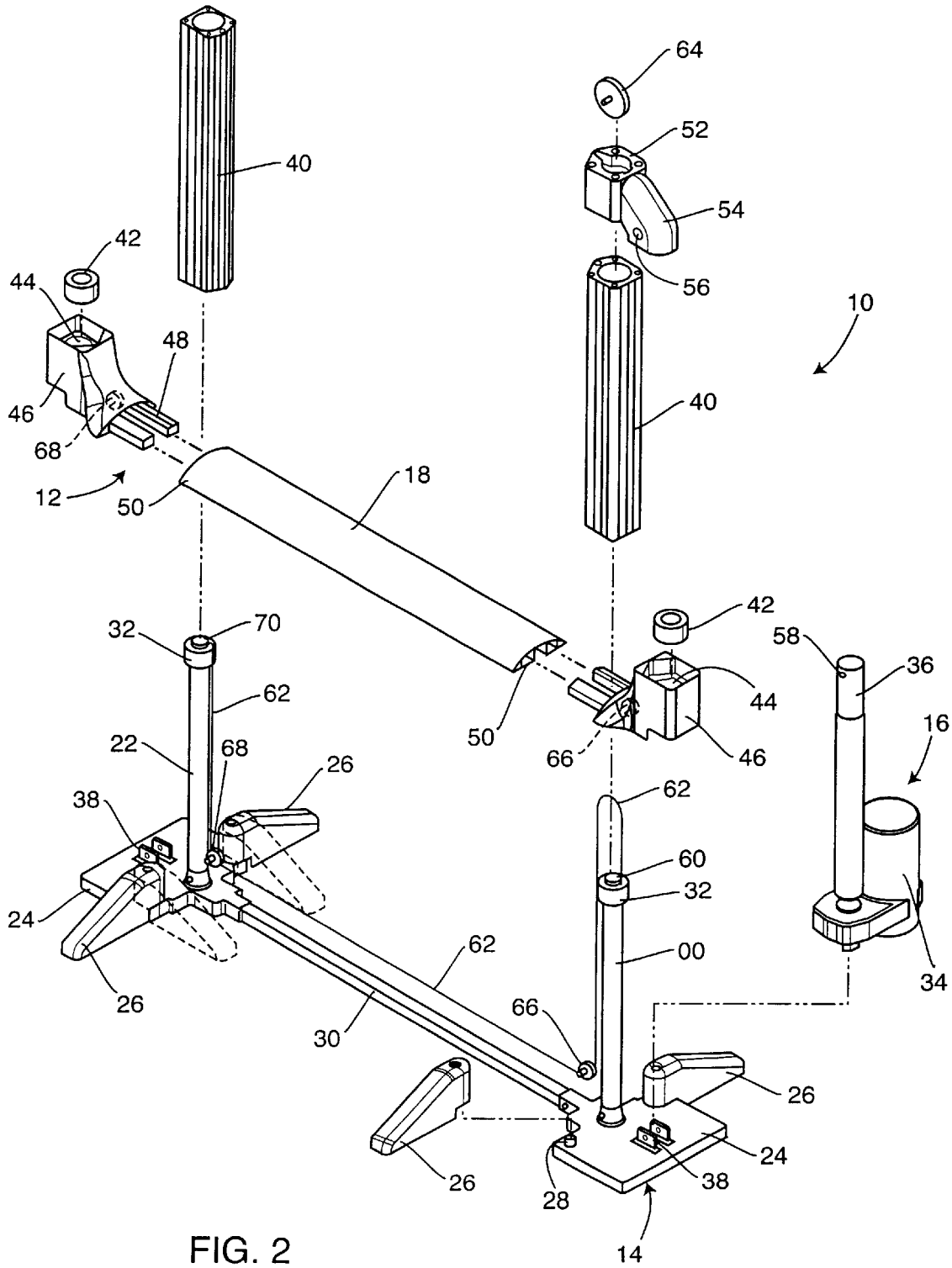
FIG. 2 is a partially exploded perspective view of the spine therapy apparatus of FIG. 1.

Referring now to FIG. 2, the base assembly 14 is generally comprised of a pair of space-apart, vertically extending guide posts 22. The guide posts 22 are typically attached to mounting plates 24 which provide stability. Additionally, each mounting plate 24 includes at least one, and preferably two, stabilizing feet 26 which are capable of pivoting over a 90° arc between a closed or folded storage position and an extended stabilizing position. Detents 28 formed in the mounting plates 24 under each of the stabilizing feet 26 cooperate with a spring loaded bearing (not shown) nested in each foot 26 to removably snap or lock the foot 26 into either the fully closed or fully extended positions. The mounting plates 24 may be interconnected by bar 30 for even further support, and to ensure that the guide post 22 are aligned with one another. Stops 32 are formed or otherwise attached to a top end of each guide post 22 opposite the mounting plate 24. The guide post 22 are preferably cylindrical in configuration, although not limited to such.

The actuator 16 includes a motor 34 operably connected to a post 36 so as to selectively raise or lower the post 36. The post 36 can be activated to extend or retract by pneumatic means, a screw mechanism, or in any other suitable fashion. Preferably, the actuator 16 is attached to one of the mounting plates 24 by, for example, mounting ears 38 extending from the mounting plate 24 which snap-fit into, or are otherwise connected to, such as with a connecting pin or the like to the actuator 16.

The lift bar assembly 12 is disposed between and slidably attached to the guide post 22. This assembly 12 includes the horizontal cross bar 18 interconnected between two lift bars 40 which are configured to interiorly receive the guide posts 22. Bearings 42 are positioned within the lift bars 40, the inner surfaces of which slide along the outside surface of the vertical guide posts 22. The bearings 42 are also configured such that upon encountering stops 32 upward motion of the lift bar assembly 12 is restricted. In a particularly preferred embodiment, the outer surfaces of the stops 32 slidably engage the inner surfaces of the lift bars 40 to provide a stable and fluid motion while the lift bar assembly 12 is raised and lowered.

Typically, the bearings 42 are secured in pockets 44 of elbows 46 which are attached to the base of each lift bar 40. The horizontal cross bar 18 is attached to the elbows 46, such as by the insertion of pegs 48 extending from the elbows 46 and into mating apertures 50 of the horizontal cross bar 18. Screws or the like can be utilized to more securely hold the horizontal cross bar 18 to the elbows 46. It is also to be understood that the horizontal cross bar 18 can be attached to the elbows 46 by other means, or even directly to the lift bars 40 themselves. Apertures can be formed along the length of the lift bars 40 for attaching the elbows 46, or cross bar 18, at more elevated starting positions to increase the pressure gradient exerted upon the spine.

A cap 52 is configured to be securely placed over a top end of one of the lift bars 40. The cap 52 includes an extension 54 which is configured to receive the extendable post 36. The extension 54 may include an aperture 56 which can be aligned with an aperture 58 of post 36 through which a connecting pin can be passed to securely connect the extension 54, and thus the lift bar assembly 12, to the extendable post 36. Thus, as the post 36 is extended upwardly, as controlled by actuator 16, the lift bar assembly 12 is also raised. Similarly, when the post 36 is gradually lowered, the lift bar assembly 12 is lowered in a similar fashion.

In order to keep the entire lift bar assembly 12 parallel to the floor and prevent binding, a cable and pulley system is employed. A first end 60 of a cable 62 is attached to the stop 32 of one of the vertical guide posts 22. The cable loops over a pulley 64 housed in the cap 52 or upper portion of the lift bar 40. The cable 62 extends over pulley 64, through cap 52, and through the length of the lift bar 40 to pulley 66 which is attached to and housed in elbow 46. The cable 62 extends from its engagement with pulley 66 under or through horizontal cross bar 18 to pulley 68 attached to and housed in the opposite elbow 46. The cable continues to extend to connection point 70 at the top of the guide post 22, typically stop 32. Thus, as actuator 16 is activated and post 36 extended upwardly, pulley 64 creates a loop of cable 62 which effectively shortens the overall length of the cable 62 over its path and causes the lower pulleys 66 and 68 within the elbows 46 to raise the entire lift bar assembly 12 in a uniform manner. The lifting force applied at lower pulley 68 complements that applied by the extendable post 36 to keep the lift bar assembly 12 parallel to the floor, as illustrated in FIG. 1.

With reference to FIG. 1, in use the fluid filled pad 20 is positioned over the horizontal cross bar 18 to provide cushioned support for the user's back. The user positions the portion of the back to be treated, typically the lower or lumbar section of the spine, over the horizontal cross bar 18 and activates actuator 16 to raise the lift bar assembly 12. The actuator 16 can include a switch for manual control by an extended arm of the user, or preferably a remote control hand-held unit is used to activate the actuator 16 to raise and lower the post 36, and thus the lift bar assembly 12. The horizontal cross bar 18 provides sufficient pressure gradient to the targeted location of the spine of the user, while the pad 20 comfortably contours to any body shape and size to eliminate uncomfortable pressure points. Thus, the user can relax during the exercise which aids in the spinal therapy as muscle tension and tightening is eliminated, allowing the vertebrae to hyper-extend and stretch more easily to eliminate vertebrae and disk compression and related pain.

Due to its design, the apparatus 10 can be broken down into its components for shipping and storage. If the apparatus 10 is to be temporarily stored between uses, the pad 20 is deflated and the feet 26 pivoted into the closed position, resulting in a folded and narrow apparatus 10 which occupies little storage space. Due to its simple design, the apparatus 10 is also light in weight and easily moved from one location to another.

Although an embodiment of the invention has been described in detail for purposes of illustration, various modifications may be made without departing from the scope and spirit of the invention. Accordingly, the invention is not to be limited, except as by the appended claims.

What is claimed is:

1. A spinal therapy apparatus, comprising:

a base assembly having a pair of spaced-apart, parallel guide posts;

a lift bar assembly including two lift bars slidably attached to the guide posts, and a cross bar interconnected between the lift bars;

an actuator for selectively raising and lowering the lift bar assembly relative to the base assembly; and a cable and pulley system for raising and lowering the lift bar assembly in a uniform manner, the cable and pulley system comprising a cable interconnection between a top portion of each of the guide posts and extending through the lift bar assembly to pulleys associated with each lift bar so that as one lift bar is raised or lowered, the other lift bar raises or lowers in a similar manner.

2. The apparatus of claim 1, including a cushioned pad disposed between the guide posts and over at least a portion of the lift bar assembly.

3. The apparatus of claim 1, wherein the actuator comprises a motor operably connected to the lift assembly.

4. The apparatus of claim 1, wherein the base assembly includes a stabilizing foot associated with each guide post and capable of pivoting from a folded to an expanded position.

5. The apparatus of claim 1, wherein the base assembly includes a plurality of stabilizing feet that pivot away from one another to an expanded and locked position to stabilize the apparatus during use.

6. The apparatus of claim 1, wherein the lift bars are configured to interiorly receive the guide posts.

7. A spinal therapy apparatus, comprising:

a base assembly having a pair of spaced-apart guide posts, and a stabilizing foot associated with each guide post and capable of pivoting from a folded to an expanded position;

a lift bar assembly including two lift bars slidably attached to the guide posts, and a cross bar interconnected between the lift bars;

a cushioned pad disposed between the guide posts and over at least a portion of the cross bar of the lift bar assembly; and an actuator for selectively raising and lowering the lift bar assembly relative to the base assembly.

8. The apparatus of claim 7, wherein the actuator comprises a motor operably connected to the lift assembly.

9. The apparatus of claim 7, wherein the base assembly includes a plurality of stabilizing feet that pivot away from one another to an expanded and locked position to stabilize the apparatus during use.

10. The apparatus of claim 7, wherein the lift bars are configured to interiorly receive the guide posts.

11. The apparatus of claim 7, including a cable and pulley system for raising and lowering the lift bar assembly in a uniform manner.

12. The apparatus of claim 11, wherein the cable and pulley system comprises a cable interconnected between a top portion of each of the guide posts and extending through the lift bar assembly to pulleys associated with each lift bar so that as one lift bar is raised or lowered, the other lift bar raises or lowers in a similar manner.

13. The apparatus of claim 7, wherein the cushioned pad comprises an elongated fluid filed pad.

14. A spinal therapy apparatus, comprising:

a base assembly having a pair of spaced-apart, vertically extending guide posts and a stabilizing foot associated with each guide post and capable of pivoting from a folded to an expanded position;

a lift bar assembly including two lift bars slidably attached to the guide posts, and a horizontal cross bar interconnected between the lift bars;

an elongated fluid filled pad disposed between the guide posts and over at least a portion of the cross bar of the lift bar assembly;

an actuator including a motor operably connected to the lift bar assembly for selectively raising and lowering the lift bar assembly relative to the base assembly; and a cable and pulley system for raising and lowering the lift bar assembly in a uniform manner.

15. The apparatus of claim 14, wherein the base assembly includes a plurality of stabilizing feet that pivot away from one another to an expanded and locked position to stabilize the apparatus during use.

16. The apparatus of claim 14, wherein the lift bars are configured to interiorly receive the guide posts.

17. The apparatus of claim 14, wherein the cable and pulley system comprises a cable interconnected between a top portion of each of the guide posts and extending through the lift bar assembly to pulleys associated with each lift bar so that as one lift bar is raised or lowered, the other lift bar raises or lowers in a similar manner.

18. A spinal therapy apparatus, comprising:

a base assembly having a pair of spaced-apart, parallel guide posts, and a plurality of stabilizing feet that pivot away from one another to an expanded and locked position to stabilize the apparatus during use;

a lift bar assembly disposed between and slidably attached to the guide posts; and actuator for selectively raising and lowering the lift bar assembly relative to the base assembly.

19. A spinal therapy apparatus, comprising:

a base assembly having a pair of spaced-apart guide posts;

a lift bar assembly including two lift bars slidably attached to the guide posts, and a cross bar interconnected between the lift bars, wherein the lift bars are configured to interiorly receive the guide posts;

a cushioned pad disposed between the guide posts and over at least a portion of the cross bar of the lift bar assembly; and an actuator for selectively raising and lowering the lift bar assembly relative to the base assembly.

20. A spinal therapy apparatus, comprising:

a base assembly having a pair of spaced-apart guide posts;

a lift bar assembly including two lift bars slidably attached to the guide posts, and a cross bar interconnected between the lift bars;

a cushioned pad disposed between the guide posts and over at least a portion of the cross bar of the lift bar assembly;

an actuator for selectively raising and lowering the lift bar assembly relative to the base assembly; and a cable and pulley system for raising and lowering the lift bar assembly in a uniform manner.

21. The apparatus of claim 20, wherein the cable and pulley system comprises a cable interconnected between a top portion of each of the guide posts and extending through the lift bar assembly to pulleys associated with each lift bar so that as one lift bar is raised or lowered, the other lift bar raises or lowers in a similar manner.

22. A spinal therapy apparatus, comprising:

a base assembly having a pair of spaced-apart guide posts;

lift bar assembly including two lift bars slidably attached to the guide posts, and a cross bar interconnected between the lift bars;

cushioned pad comprising an elongated fluid filled pad, disposed between the guide posts and over at least a portion of the cross bar of the lift bar assembly; and an actuator for selectively raising and lowering the lift bar assembly relative to the base assembly.

23. A spinal therapy apparatus, comprising:

a base assembly having a pair of spaced-apart, parallel guide posts;

a lift bar assembly including two lift bars slidably attached to the guide posts and a cross bar interconnected between the lift bars; and an actuator for selectively raising and lowering the lift bar assembly relative to the base assembly for raising and lowering a portion of a spine placed over the cross bar.

24. The apparatus of claim 23, including a cushioned pad disposed between the guide posts and over at least a portion of the lift bar assembly.

25. The apparatus of claim 23, wherein the actuator comprises a motor operably connected to the lift assembly.

26. The apparatus of claim 23, wherein the base assembly includes a stabilizing foot associated with each guide post and capable of pivoting from a folded to an expanded position.

27. The apparatus of claim 26, wherein the base assembly includes a plurality of stabilizing feet that pivot away from one another to an expanded and locked position to stabilize the apparatus during use.

28. The apparatus of claim 23, wherein the lift bars are configured to interiorly receive the guide posts.

29. The apparatus of claim 23, including a cable and pulley system for raising and lowering the lift bar assembly in a uniform manner.

30. The apparatus of claim 29, wherein the cable and pulley system comprising a cable interconnected between a top portion of each of the guide posts and extending through the lift bar assembly to pulleys associated with each lift bar so that as one lift bar is raised or lowered, the other lift bar raises or lowers in a similar manner.

* * * * *